US005207408A

United States Patent [19]

Burg

[11] Patent Number: 5,207,408

[45] Date of Patent: May 4, 1993

[54] STABILIZED AIR SUPPORTED STRUCTURE

[76] Inventor: Donald E. Burg, 15840 W.W. 84 Ave., Miami, Fla. 33157

[21] Appl. No.: 804,235

[22] Filed: Dec. 5, 1991

Related U.S. Application Data

[63] Continuation-in-part of Ser. No. 180,246, Apr. 11, 1988, abandoned, and a continuation-in-part of Ser. No. 514,123, Apr. 25, 1990, abandoned.

[51] Int. Cl.[5] ..... B63B 17/00

[52] U.S. Cl. ..... 248/550; 33/518; 114/284; 248/562

[58] Field of Search ..... 248/550, 560, 562, 564, 248/603, 610, 618, 631, 637, 646, 660; 33/318; 180/41; 114/71, 203, 284; 74/5.22

[56] References Cited

U.S. PATENT DOCUMENTS

| | | | |
|---|---|---|---|
| 3,410,357 | 11/1968 | Summers | 74/5.22 |
| 3,731,543 | 5/1973 | Gates | 33/318 |
| 3,731,544 | 5/1973 | Acker | 74/5.22 |
| 4,351,262 | 9/1982 | Matthews | 114/284 |
| 4,392,445 | 7/1983 | Burg . | |
| 4,477,045 | 10/1984 | Karasawa | 248/550 |
| 4,587,918 | 5/1986 | Burg . | |
| 4,589,620 | 5/1986 | Sakamoto | 248/550 |
| 4,735,164 | 4/1988 | Burg . | |
| 4,739,719 | 4/1988 | Burg . | |

FOREIGN PATENT DOCUMENTS

| | | | |
|---|---|---|---|
| 21696 | 8/1961 | German Democratic Rep. | 114/71 |
| 92441 | 6/1982 | Japan . | |
| 221786 | 12/1983 | Japan . | |
| 221788 | 12/1983 | Japan . | |
| 221789 | 12/1983 | Japan . | |
| 1100123 | 1/1968 | United Kingdom | 248/562 |

*Primary Examiner*—J. Franklin Foss

*Attorney, Agent, or Firm*—Robert J. Van Der Wall

[57] ABSTRACT

Presented is a way to stabilize and support a secondary structure, such as a passenger compartment in a moving vehicle, so that the supported or secondary structure remains substantially level and stable and mostly free of primary or parent structure undesired motions. Application can be to stationary parent structures or to vehicular parent structures such as boats, trains, aircraft, and the like. The secondary structure is stabilized and supported by a pressurized gas cushion. The pressurized gas cushion can be used in combination with gyrostabilizers and/or connectors that may be in the form of active or passive systems. Connectors may be in the form of simple ball and socket or hinge arrangements. The latter would preferably be positioned proximal the most stable and motion free part of the parent structure.

96 Claims, 3 Drawing Sheets

STABILIZED AIR SUPPORTED STRUCTURE

CROSS REFERENCE TO OTHER APPLICATIONS

This application is a continuation-in-part to applicant's earlier applications, Ser. No. 180,246 filed Apr. 11, 1988, now abandoned, and Ser. No. 514,123 filed Apr. 25, 1990, now abandoned.

BACKGROUND OF THE INVENTION

This invention presents a way to stabilize and support a structure, such as a passenger compartment in a moving vehicle, so that the supported or secondary structure remains level and stable and mostly free of primary or parent structure undesirable motions. For Example, if the parent structure is a boat hull a secondary structure in the form of a passenger cabin can be made mostly free of vibration and pitch, roll, and yaw motions associated with the boat hull while the boat is either at rest or under way. The instant invention can be applied to stationary applications and to all manner of vehicles, including boats, trains, aircraft, and the like.

There have been attempts to stabilize entire vehicles with a prime example being gyrostabilizers used on boats and ships. The action of a gyrostabilizer is based on the elementary principal of a gyroscope whereby movement of the vessel is resisted by the precessional forces of the gyroscope. The basic fixed position gyrostabilizer can be classified as a passive or responsive system. A refinement of this is the Sperry Gyrostabilizer whereby a small pilot gyroscope is used to actuate the primary, or ship motion resisting, gyroscope so as to cause the primary gyroscope to precess in a direction opposite to that which would result from rolling or other motions of the ship. This is referred to as an active gyrostabilizer. These systems have been installed in large ships and an application in a 40,000 ton ship of a system with three active gyrostabilizers with rotors 13 feet in diameter has been successfully made. The aggregate weight of the three gyrostabilizers when installed was 690 tons or about 1.72 percent of ship displacement. Hull roll reduction accomplished by this installation was about 60 percent while roll reduction of as much 80 percent has been demonstrated on smaller vessels. Gyrostabilizers are described on page 253 of "Modern Ship Design", Second Edition, by Thomas C. Gillmer, Published by Naval Institute Press, Annapolis, Md., 1977. They are also described in the section 3.14 Gyroscopic Stabilizers that is presented on pages 687–689 of "Principals of Naval Architecture" (PNA), Fourth reprinting August, 1977, Edited by John P. Comstock, Published by The Society of Naval Architects and Marine Engineers, 74 Trinity Place, New York, N.Y. 10006. It is to be noted that, on page 689, PNA states, "The principal drawbacks for commercial installations are their cost, weight and size, the space they require, and the power they consume." The instant invention solves the just mentioned deficiency since only the supported structure requires gyroscopic stabilization. This is described in more detail, by way of example, in a following paragraph in this section.

The instant invention actually floats or supports the secondary structure with lifting force supplied by a pressurized gas, normally air, cushion in its preferred embodiment. This offers tremendous benefits since a passenger cabin, for example, can be supported and isolated from parent vehicle movements. There have been successful applications of lifting air cushions applied to primary vehicles, for example Hovercraft and my Air Ride Boat inventions. These air cushion supported vehicles are very efficient; however, they still subject passengers and other cargo to vehicle movements since the passenger cabins are affixed directly to the primary vehicle. Even the use of springs and/or shock absorbers, as are used in automobile suspension systems and some marine and other vehicles, are not truly effective in isolating primary vehicle movement and vibration from the supported structure and its contents. Further, spring mounted systems or the like still allow the supported structure to vibrate and roll, pitch, and yaw in accord with primary vehicle movements only at a slightly reduced or dampened rate. Importantly, the previous supporting systems rely on springs, pneumatic or hydraulic actuators, shock absorbers or other similar means to both carry the full weight of and stabilize the supported structure.

Since the preferred version of the instant invention separates the secondary structure from the parent structure and supports the secondary structure with pressurized gas, the loads on connectors such as springs, pneumatic or hydraulic actuators, shock absorbers or other means is reduced many fold; therefore, the size and power requirements, where required, for these connectors is reduced tremendously also. Further, in the preferred version of the instant invention, connectors may only restrain, which is a form of stabilizing and/or supporting, the secondary structure when it approaches an overtravel position relative to the parent structure. It is also apparent that a connecting seal can act as a stabilizing and/or supporting connector.

Compared to a gyrostabilizer for a complete vehicle, the instant invention would utilize much smaller, lighter, faster responding, and less expensive gyrostabilizers since only the secondary structure need be stabilized by the gyrostabilizer. As an example of the magnitude of difference, consider that a fully loaded 102 by 34 foot Air Ride passenger ferry, including a fixed cabin with passengers, weighs approximately 140 long tons while, if separated as a secondary structure, the cabin including passengers weighs only about 40 long tons. Further, in the preferred embodiment of the present invention, a gyrostabilizer for the secondary structure is only working to stabilize a floating air supported cabin and not a boat hull that is subject to heavy force wave impacts. It is obvious that water presents much stronger impacts than air as it is approximately 800 times as dense. The terminology used to describe the preferred, air supported, version of the instant invention is Stabilized Air-Supported Structure which has the acronym SASS.

There is currently an attempt being made to develop a pitch and roll free ship's cabin by Mitsubishi Heavy Industries, Ltd. (MHI) of Japan. MHI's approach is to support the cabin with hull attached hydraulic actuators that are attached in series to shock absorbers where the shock absorbers are in turn attached to the supported cabin. Per an article from page 6 of the February 1988 issue of "Maritime Reporter and Engineering News" magazine, Editorial Offices, 118 East 25th Street, New York, N.Y. 10010, "A computer detects pitch and roll and dampens this by adjusting hydraulic cylinders, keeping the cabin level. The impact of motion is also absorbed by the shock-absorbing system." While MHI's approach is certainly workable, as demonstrated by a 48½ foot demonstration hull that MHI has built, the instant invention provides significant advantages. Major disadvantages of the MHI system, compared to the instant invention, are that the MHI system requires support of all cabin weight and full cabin stabilization by the hydraulic cylinder and shock absorber connectors. The advantages of the instant invention are discussed in some detail in following sections.

There have been some patent activities that have at least some resemblance to the MHI system described in the "Maritime Engineering and Engineering News" magazine article. These include Tugwood, Great Britain Patent Specification 1,100,123, who describes a dampened spring mounted equipment carrier. Tugwood's is a device for protecting equipment from shock and vibration and cannot actively maintain a level carrier except by spring action so carrier orientation is dependent upon the orientation of the parent surface. That coupled with the fact that Tugwood has only anti-vibration spring and damper elements widely separate his patent from the instant invention. Liehmann, East German Patent 21,696, describes a hinged arm mechanism for maintaining a cabin-like structure. Liehmann has a similar limitation as the MHI concept in that all weight is supported by the arms rather than a large air cushion that floats the entire secondary structure as does the preferred embodiment of the instant invention. Further, Liehmann does not offer a gyroscope to orient the carrier by means of its precessional forces so his patent bears little resemblance to the instant invention.

Another concept is presented by Seiskusho, et al., Japan Patent 57-92441, who shows a suspended body that is supported by tensioned coiled threadlike support arms. The suspended body is positioned between parallel sides of a U-shaped fixed support frame structure. In Seiskusho's concept the supported body is always in essentially the same orientation in relation to the fixed support frame so supported structure orientation is not controllable, there is no supporting air cushion, and there is no gyrostabilizer in communication with the suspended structure; therefore, Seiskusho's invention has little resemblance to the instant invention.

Attempts at air supported structures include Sakamoto, U.S. Pat. No. 4,589,620, who shows a seat supported by a pneumatic cylinder and Karasawa; et al., U.S. Pat. No. 4,477,045, who shows a table that is supported by small air cylinders mounted on each corner of the table. While there two patents do present air cylinders as a means of support they do not offer the full size air support system of the preferred embodiment of the instant invention where the air support covers essentially the entire lower surface of the supported structure and therefore floats the supported structure on the air cushion. They also do not use gyroscope precessional forces to orient and stabilize the supported structure as is a part of the preferred embodiment of the instant invention. So, while there two patents do offer pressurized air support systems, they actually have little resemblance to the instant invention.

Matthews, U.S. Pat. No. 4,351,262, presents an unusual air cushion in a boat. He has a more or less standard catamaran hull form with a center wave following hull portion located between the catamaran sidehulls. Pressurized air is fed into the chamber between the upper and lower hull portions. Matthews does not offer stability beyond that of a standard catamaran hull, does not offer a stabilized air supported structure, and does not utilize a gyrostabilizer for any portion of his invention. Therefore, although he does show an air cushion under a boat hull, Matthews does not offer any of the valuable features of the instant invention.

Summers, U.S. Pat. No. 3,410,357, presents a gyro stabilized center-tracking motorcycle-like vehicle for travel over solid surfaces only. Summers offers a novel means to orient the gyro in the form of roadbed tracking wheels that return the gyro to its normal position in the event that it has been displaced. In any event, Summers does not employ a large pressurized air cushion for supporting and floating a secondary structure that is in turn gyrostabilized as in the case of the instant invention.

Gates, U.S. Pat. No. 3,731,543 and Acker, et al., U.S. Pat. No. 3,731,544, show rather complicated gyroscope based alignment systems. Gates is for a boresight alignment system for guns, rocket launch rails, and the like and Acker, et al. includes a star tracking system that uses the precise location of two known stars to update the position data in a gyroscopically based navigation system. While the control and operation of these two very complicated devices are based upon output data from gyroscopes they bear little resemblance to the instant invention. In the preferred embodiment of the instant invention, a secondary structure is supported primarily by a pressurized air cushion that has essentially the same support area as the lower surface of the supported structure, thus actually "floating" the supported structure, and the precessional forces of a powerful gyroscope are utilized to orient and stabilize the heavy supported structure, and the precessional forces of a powerful gyroscope are utilized to orient and stabilize the heavy supported structure that is, in its primary application, the passenger cabin in a boat or ship.

Variations of the present invention, other than the preferred embodiment which has a gas pressure supported and gyrostabilizer stabilized secondary structure, include: a gas pressure supported and connector stabilized secondary structure, a gyrostabilizer stabilized and connector supported secondary structure, and a secondary structure that is at least partially supported by a ball and socket, hinge, or other passive supporting system. Each variation can include portions of the others and can further include at least partial gas pressure stabilization for the secondary structure.

SUMMARY OF THE INVENTION

With the foregoing in mind, it is the principal object of the present invention to provide a stabilized supported secondary structure that is applicable to use with a variety of primary or parent structures. Some examples of parent structures are boat hulls, trains, busses, and airplanes.

A primary object of the present invention is to provide a pressurized gas cushion between the parent and supported structures that provides support for and, in some instances, at least partial stabilization for the secondary structure.

Another primary object of the invention is to provide pressurized gas for a secondary structure cushion support system with a low cost blower or other pressurized gas supply device which may further include an optional pressure regulating device.

Yet another object is to provide gas cushion pressurized gas from an existing gas pressure supported main vehicle or parent structure, such as the Air Ride boat inventions, gas cushion and/or gas cushion pressurized system.

Similarly, a related object of the invention is to provide gas cushion pressurized gas from the secondary structure gas cushion to a parent structure supporting gas cushion.

Another related object of the invention is to provide a means of controlling the rate of gas supply and hence the pressure of gas flowing between a secondary structure gas cushion and a parent structure gas cushion.

A further object of the invention is to provide a means to vent the secondary structure gas cushion to thereby control secondary structure gas cushion pressure.

Yet another object of the invention is to provide a recess in the parent structure where such recess forms at least part of the boundary of the secondary structure supporting and/or stabilizing gas cushion.

A similar object of the invention is to provide a recess in the supported structure where such recess forms at least part of the boundary of the secondary structure supporting and/or stabilizing gas cushion.

One more object of the invention is to provide for a unitary gas cushion that extends through the parent structure so that there is a unitary gas cushion that supports and/or stabilizes the secondary structure and also has a waterline, or other medium's surface that is not a portion of either the parent or secondary structure, as one of its boundaries.

Another object of the invention is to insure proper orientation and stability of the secondary structure by means of a gyrostabilization system.

A related object of the invention is to provide a means to control the orientation of a secondary structure stabilizing gyroscope.

Further, another object of the invention is to provide the parent structure, such as a boat hull, and/or the secondary structure with motion sensing devices that feed their outputs into a device, such as a microprocessor controller, that in turn directs the orientation of a secondary structure gyrostabilizer.

Yet another object of the invention is to provide a seal member, normally of a flexible and/or resilient material, that effectively connects the secondary structure to the primary structure to form a seal that restricts pressurized gas leakage from the secondary structure gas cushion.

Another primary object of the invention is to provide connector means that can support and/or stabilize the secondary structure; such as shock absorbers, pneumatic or hydraulic actuators, ball and socket joints, universal joints, cables or ropes, or the like and including a gas seal element in some variations; to connect the secondary structure to a parent structure.

It is to be realized that another object of the invention is to be able to utilize a gas sealing member, that would normally connect the parent and secondary structures, as a connector that can support and/or stabilize the secondary structure in similar fashion to other possible connectors, including shock absorbers, pneumatic or hydraulic actuators, ball and socket joints, universal joints, cables or ropes, and the like.

A further object of the invention is to provide the parent structure, such as a boat hull, and/or the secondary structure with motion sensing devices that feed their outputs into a device, such as a microprocessor controller, that in turn directs the operation of secondary structure connection means where the secondary structure connection means can be pneumatic or hydraulic actuators or the like.

Simplifying variations of the invention can have a single large ball and socket or a hinge like arrangement to connect the parent and secondary structures. When the ball and socket or hinge are positioned to be near the lowest force and/or movement position of the parent structure, particularly in such case where the parent structure is a boat, the result is a simpler and less expensive concept. The ball and socket, or similar design, offers movement to compensate for pitch, roll, and yaw of the parent structure while the simpler hinge concept allows movement to compensate for pitch only. In the case of a very wide beam hull, such as the Air Ride boat inventions which have exceptionally good roll stability, the simplest hinge concept is very acceptable.

A further improvement related to the invention is to offer a variation in the shape of the lower pressurized gas supported surface so that gas forces generated moments about the mounting point, particularly in the case of ball and socket or hinge mounts, will be evenly distributed.

The invention will be better understood upon reference to the drawings and detailed description of the invention which follow in which:

DETAILED DESCRIPTION

With reference to each of the aforementioned figures in turn, and using like numerals to designate similar parts throughout the several views, a preferred embodiment and several alternative embodiments will now be described.

Figure 1:
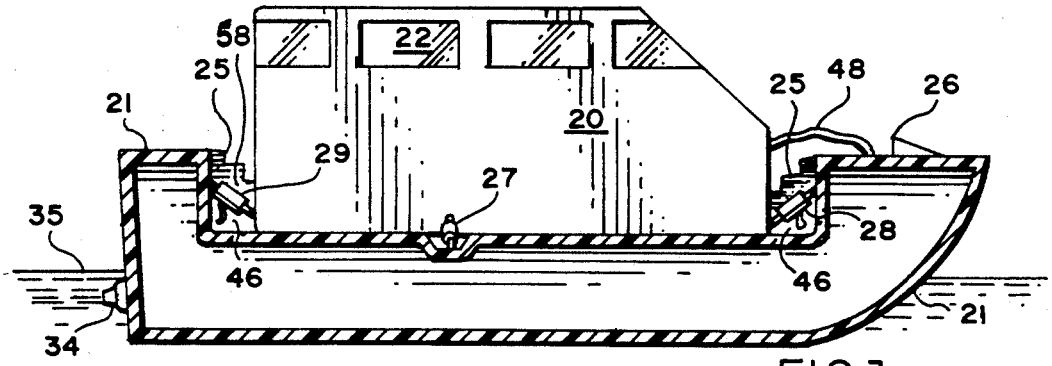
FIG. 1 is a longitudinal cross sectional view of a primary structure, in this case a vehicle in the form of a boat as taken through line 1—1 of FIG. 4, which shows a secondary structure, in this case a passenger compartment, in the not suspended or at rest state where it is resting against the parent structure.
Figure 4:
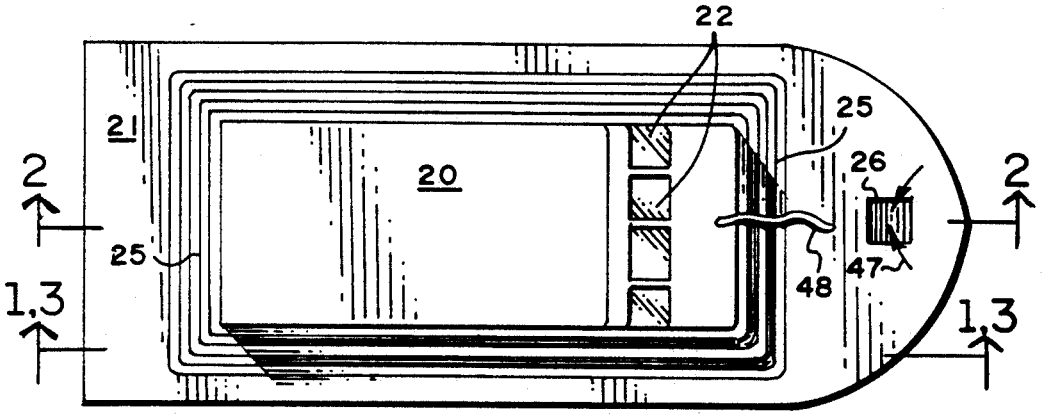
FIG. 4 is a top view of the boat presented in FIG. 2 and one version of FIG. 8 that shows the secondary structure and gas sealing flexible member that connects the parent and secondary structures.

FIG. 1 shows a longitudinal cross sectional view of a primary structure 21, in this case a boat hull 21 as taken through line 1—1 of FIG. 4. Shown in full side view is a secondary structure 20, in this example a passenger cabin 20 with windows 22. The secondary structure 20 is shown in its at rest or not air-supported mode where it is resting in contact with a recess 58 in the primary structure 21. Also shown in FIG. 1 are a side connector 27, forward connector 28, and aft connector 29. While connectors 27–29 are shown in preferred locations, it is also contemplated that either more or less connectors can be used and that they can be differently located. For example, a single connector located on parent structure 21 centerline and approximately at the longitudinal center of the supported structure 20 could be used. It is also contemplated that any connector(s) 27–29 or seal(s) 25 that connect the primary structure 21 and the secondary structure 20 may not be in direct contact with either structure 20,21 as there may be intermediate attachment devices, not shown, that actually join the connector(s) 27–29 and/or seal(s) 25 to either structure 20,21. Further, two or more connectors 27–29, seals 25, or the like may be attached to each other if desired.

The connectors 27–29 may be shock absorbers, pneumatic or hydraulic actuators, ball and socket joints, universal joints, cables or ropes, other connection means including the seal elements 25 that connect the secondary structure 20 to the parent structure 21, or combinations of same. Note that connectors 27–29 such as pneumatic or hydraulic cylinders may be active, hence the term actuator, where they would actively move to help control secondary structure 20 position or passive when they would act more as simple shock absorbers. Other items shown in FIG. 1 include air or other gas blower inlet duct 26, electrical cable 48, waterjet propulsor 34, and waterline 35, and the previously mentioned seal elements 25 for sealing gas into a chamber 46. These seal elements 25 can also serve as connectors such as connectors 27–29.

Figure 2:
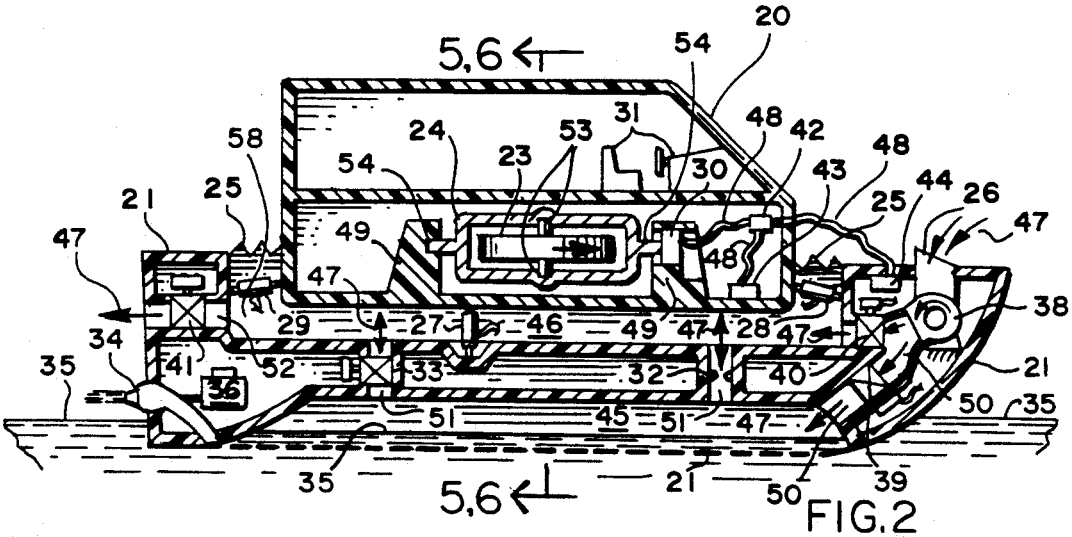
FIG. 2 is a centerline cross section of the vehicle of FIG. 1, as taken through line 2—2 of FIG. 4, that presents a boat with the secondary structure or floating compartment suspended by gas pressure lifting forces. In this instance, the secondary structure cushion gas pressure is supplied by a blower or other pressurized gas supply device that also provides main vehicle cushion gas pressure that acts against the water surface under the hull where such gas pressure actually supports much of the weight of the parent vehicle itself. Additional details in FIG. 2 show a secondary structure gas cushion pressure control vent, gyroscopic stabilization system in the secondary structure and a waterjet propulsor and its drive engine. Note that the secondary structure could also be fully or partially supported and/or stabilized by connectors such as pneumatic or hydraulic actuators.

FIG. 2 presents a centerline cross section, as taken along line 2—2 of FIG. 4, of the primary structure 21 and secondary structure 20, including a pilot station 31. Items shown in the primary structure 21, in this case an Air Ride boat hull 21, include blower or other pressurized gas supply device inlet duct 26, blower or other pressurized gas supply device 38, and blower or other pressurized gas supply device discharge ducts 50 used to supply air 47 to the primary vehicle air cushion 45 and secondary structure air cushion 46. Gas, normally air, flow and pressure can be regulated by valves 39,40. Note that, although pressurized air 47 is shown directed to the secondary structure supporting gas cushion 46 at its lower forward portion only in FIG. 2, pressurized air 47 may be selectively directed to any portions of the secondary structure supporting gas cushion 46 and could therefore be used to either partially or fully stabilize the secondary structure 20 with reference to the parent structure 21. Control valves such as valve 40 could be of immense value for accomplishing the latter. The parent structure recess 58 could also be valuable in this regard as it would help locate the secondary structure 21 with regard to the parent structure 21.

It is also possible to transfer air 47 from the parent structure air cushion 45 to the secondary structure air cushion 46 or vice versa through devices such as valve 33 or duct 51 which may include an orifice 32 or other flow regulating device such as a venturi, not shown.

A variation of the instant invention utilizes a unitary gas cushion, not shown, for supporting the parent structure 21 and/or the secondary structure 20; a unitary gas cushion of that type would extend or penetrate through the parent structure 21 with its lower portion being the waterline 35 below the primary structure 21 in this marine example. The waterline 35 shown actually separates the parent structure supporting gas cushion 45 from the parent structure 21 supporting medium, in this case water. Also included in the primary structure 21 is a vent valve 41 in duct 52 for venting air 47 from a secondary structure air cushion 46, waterjet propulsor 34, propulsor engine 36, waterlines 35, parent structure motion sensor 44, and secondary structure motion sensor 43. Motion sensors can be in the form of accelerometers that sense g-forces and/or a pilot gyroscopes that sense orientation either of which are commercially available and are therefore conventional, or other such motion sensing devices.

Other items shown in FIG. 2 include connectors 27–29 that would normally connect the primary structure 21 and the secondary structure 20. These connectors 27–29 may be active or passive, in the active version they would most commonly be controlled by controller 42, generally a micro processor, that could base its output on data it receives from primary structure motion sensor 44 and/or secondary structure motion sensor 43 through electrical cables 48 or similar means. In the case of pneumatic or hydraulic actuators 27–29 pneumatic or hydraulic lines, pneumatic or hydraulic pumps and accumulators, and pneumatic or hydraulic control systems are generally required; however, they are not shown to simplify the drawings since they are standard commercially available systems and are therefore conventional. The controller 42 would generally be used to direct the pneumatic or hydraulic control systems, not shown since they are commercially available and therefore conventional, that would in turn actuate the pneumatic or hydraulic actuators 27–29. Note that the connectors 27–29, or seal 25, when it acts as a supporting and/or stabilizing connector, could actually be used to support and/or stabilize the secondary structure 20; further, this could be accomplished with no gas pressure in the secondary structure gas cushion 46 if desired or if necessary because of failure of the gas pressurized device 38.

Further shown attached to the secondary structure 20 in FIG. 2 is a stabilizing gyroscope or gyrostabilizer rotor 23 inside of its support cage or gimbal 24 with the support cage axles 54 supported by pillars 49. The gyroscope rotational drive motor system is not shown to simplify the drawings but would normally drive the gyroscope rotor 23 through its axle 53 or by means of contact with the gyroscope rotor 23 periphery, either of these or other drive methods may include a disconnect clutch, not shown. The gyroscope cage or gimbal 24 and hence the rotor 23 can be rotated by motor 30, normally a servo motor, to obtain optimum precessional force orientation to resist the movement of the secondary structure 20 from a level or stable orientation. In this example, the motor 30 can only tilt the gyroscope rotor 23 port and starboard and therefore can control roll motion of the secondary structure 20 only. It is possible to control pitch motion by either rotating the gyroscope cage or gimbal axis 54 and also mounts 49 by 90 degrees in a horizontal plane or by adding a full dual circular cage or gimbal gyroscope mounting system. The full circular cage gyrostabilizer is not shown to simplify the drawings; however, it is a simple gyroscope, as described on page 436 of G Volume 8, "The World Book Encyclopedia" 1977, Published by Field Enterprises Educational Corporation, Chicago, only with separate orientation drive motors, such as motor 30, which are normally servo motors, installed to drive each gimbal or cage 24. The dual circular cage gyroscope mounting system, when motor driven, would allow full control of gyroscope 23, and hence precessional force, orientation but would use up much valuable space in the secondary structure 20. The most normal situation for the instant invention is to utilize two or more motor driven gyroscopes, one mounted as shown for port and starboard or roll control and the other, rotated 90 degrees in a horizontal plane, mounted for fore and aft or pitch control. This would require much less vertical space inside the secondary structure 20 than a full motor driven dual circular cage gyroscope system.

Outputs from parent structure motion sensor 44 and/or supported structure motion sensor 43, typically g-force values from accelerometer(s) and/or orientation values from pilot gyroscope(s) that are a principal part of the motion sensor(s) 43,44, are fed into a microprocessor or similar computer system 42. The microprocessor 42 then analyzes the data it receives from the motion sensor(s) 43,44, normally by way of a software program built into the microprocessor 42, and in turn generates outputs to control orientation motor(s) 30, generally servo motors, that tilt the stabilizing gyroscope(s) cage or gimbal 24 and hence its rotor 23 so that the stabilizing gyroscope rotor(s) 23 precessional forces can be applied at their optimum orientation to counteract secondary structure 20 pitch, roll, and/or yaw motions. The same general approach is applied in the case of pneumatic, hydraulic, or other actuators 27–29 where the microprocessor 42 output is used to direct a pneumatic, hydraulic, or other controller, not shown since such controllers are available commercially and are therefore conventional. The microprocessor 42 output directs or controls positioning of the actuators 27–29 so that the secondary structure 20 can be maintained at its preferred level and stable position.

Figure 3:
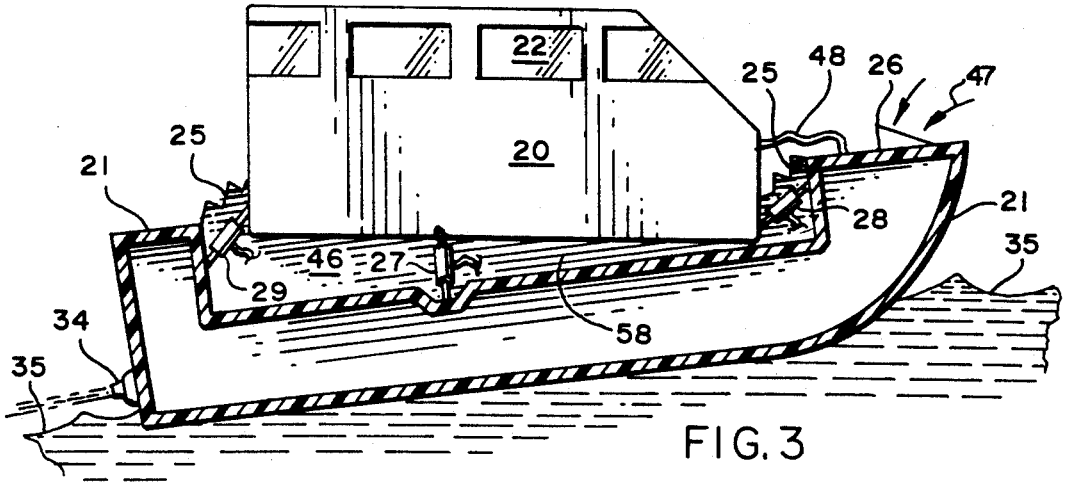
FIG. 3 is a longitudinal cross sectional view of the parent structure or boat hull of FIG. 2 as taken through line 3—3 of FIG. 4, but with the boat hull in a pitch up attitude due to encounter with a large wave. The workings of the secondary structure compartment stabilization system have allowed the secondary structure compartment to remain at substantially the same level and stable position that it experienced in calm water as shown in FIG. 2.

FIG. 3 shows a cross sectional view of the parent structure, in this instance a boat hull 21 including recess 58, as taken through line 3—3 of FIG. 4 which also shows a secondary structure 20, in this instance, the boat hull 21 has encountered a large wave, shown by waterline 35, that pitches the hull 21 upward. Note that the secondary structure 20 has maintained a stable and level attitude which is attributable to its air-supported or floating mode which separates it from the hull 21 combined with the effects of a gyrostabilizer, not shown, located in the secondary structure 20 and/or actuator connectors 27–29. The optional control systems for the gyrostabilizer and actuator connectors are described under the description of FIG. 2 just preceding so they will not be repeated here. Other items shown in FIG. 3 include gas sealing member 25, blower air inlet 26, air flow arrows 47, secondary structure windows 22, air chamber 46, waterjet propulsor 34, and electrical cable 48.

FIG. 4 presents a plan view of the parent structure 21, in this case a boat hull 21, of FIGS. 1–3. Included in this view are the secondary structure 20 with windows 22, air inlet 26, air flow arrows 47, and a seal member 25 that connects the secondary structure 20 and the parent structure 21. The seal 25 may not be continuous and may even include portions that are not in contact such as labyrinth seals which allow a controlled amount of leakage. Labyrinth seals and other controlled leakage type seals, not shown, are well known in the art and are therefore conventional.

Figure 5:
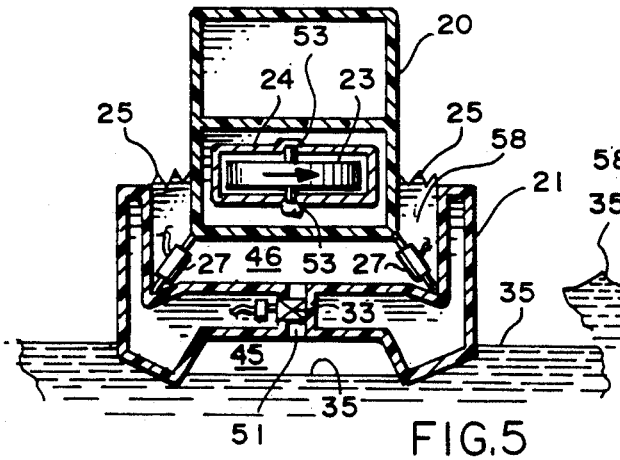
FIG. 5 is a transverse cross sectional view, as taken through line 5—5 of FIG. 2, that shows operation with the boat hull or parent structure in calm water with the cabin or secondary structure suspended.

FIG. 5 shows a transverse cross sectional view, as taken through line 5—5 of FIG. 2, of a boat hull 21, in calm water as shown by waterlines 35, with the secondary structure 20 in the air supported or floating mode. Other items shown are a gyroscope rotor 23, gyroscope axis 53, gyroscope cage 24, side connectors 27,27, secondary structure air cushion 46, air cushion seal 25, connecting duct 51, connecting duct valve 33, and parent structure, in this case an Air Ride boat hull, air cushion 45. The secondary structure supporting gas cushion 46 is shown to be partially in a recess 58 in the parent structure 21. This recess 58, although desirable, is not necessary to make the present invention workable. The invention is also workable with no recess or with a recess in the secondary structure 20. The latter approaches would just require a relocation of the seal 25 attachment points on the parent structure 21 and/or the secondary structure 20.

Figure 6:
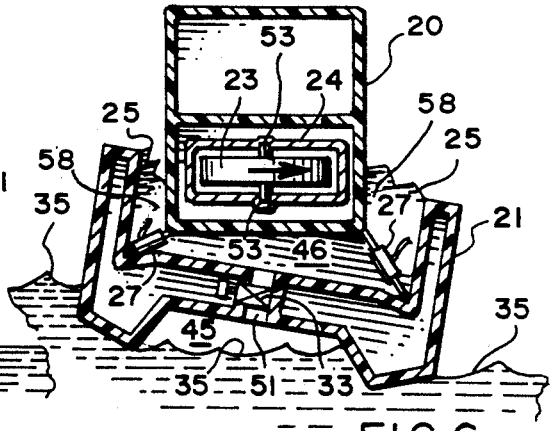
FIG. 6 presents a transverse cross sectional view, as taken through line 6—6 of FIG. 2, that shows the boat operating in rough beam seas with the cabin suspended. Note that the cabin orientation remains level and stable.

FIG. 6 presents a transverse cross sectional view, as taken through line 6—6 of FIG. 2 of the same boat hull 21 as described under FIG. 5 only with the hull 21 tilted due to wave action as can be seen by examining waterlines 35. In this instance it can be seen that the secondary structure 20 remains level and stable. The discussion appropriate to this is essentially the same as that presented in the description of FIG. 3 so it will not be repeated here. The items shown in FIG. 6 are the same as those presented under the discussion of FIG. 5 so please refer to that just preceding discussion for item descriptions.

Figure 7:
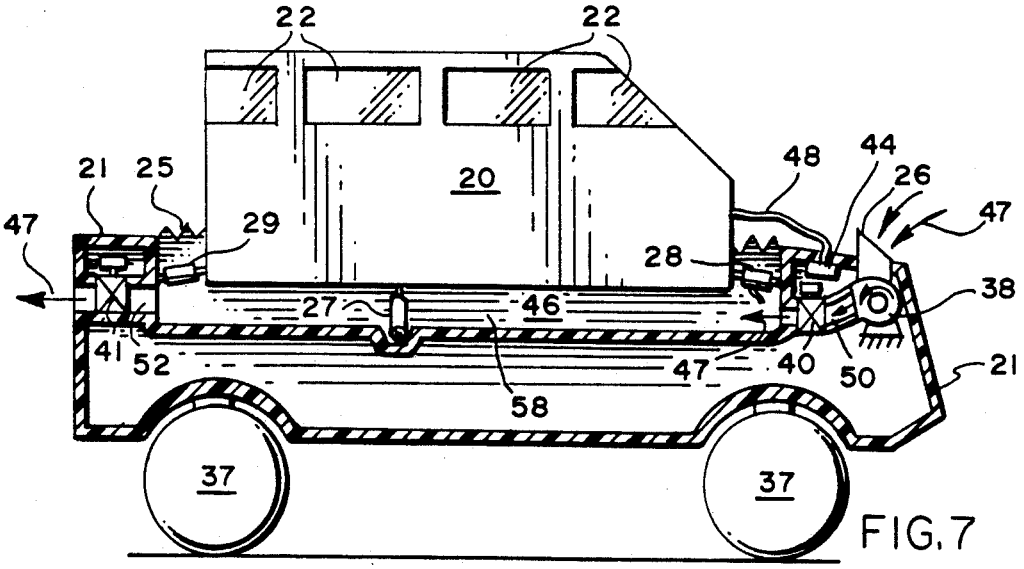
FIG. 7 is a cross sectional view showing an example of the use of this invention in a vehicle other than a boat. In this case, the vehicle is a bus; however, use in numerous other applications such as trains, large ships, aircraft, and the like is also within the contemplation of the invention.

FIG. 7 shows a cross sectional view of a parent structure 21, in this case a bus 21 with wheels 37, which also shows a secondary structure 20 as could be mounted thereon. The secondary structure 20 is supported by pressure in air cushion 46 where the air comes in through inlet 26 as shown by air flow arrows 47, is pressurized by a blower or other pressurized gas supply device 38 and then supplied thorough duct 50 or other means and optional control valve 40 to an air cushion 46. It is also an intention of this invention to provide for a fully sealed secondary structure supporting pressurized gas cushion 46 which can be accomplished, of course, by closing items such as valves 40,41. Pressurized gas supply devices 38 can be items such as blowers, piston or other type compressors, pressurized gas tanks, or other commerically available items and are therefore conventional. The gas seal 25 may be essentially positive sealing or may include a dynamic leakage type, such as a common labyrinth seal which is designed for a controlled dynamic leakage, or the seal may also include at least some fully open passages. It is also possible that a dynamic leakage type seal could be utilized either partially or fully around the secondary structure resulting in seal elements that are not in contact. In such latter case, a pressurized gas supply device 38 would require flow and pressure capacities to handle such gas leakages. Other items shown include secondary structure supporting air cushion 46, parent structure recess 58, vent duct 52 and valve 41, secondary structure connectors 27-29, electrical cable 48, primary vehicle motion sensor 44, and the secondary structure windows 22. This presentation is similar to that made concerning FIG. 2 only the parent structure 21 is a bus 21 rather than a boat hull. One other difference is that there is no lifting air cushion in the lower side of the vehicle 21 which is, of course, an option for the present invention.

Figure 8:
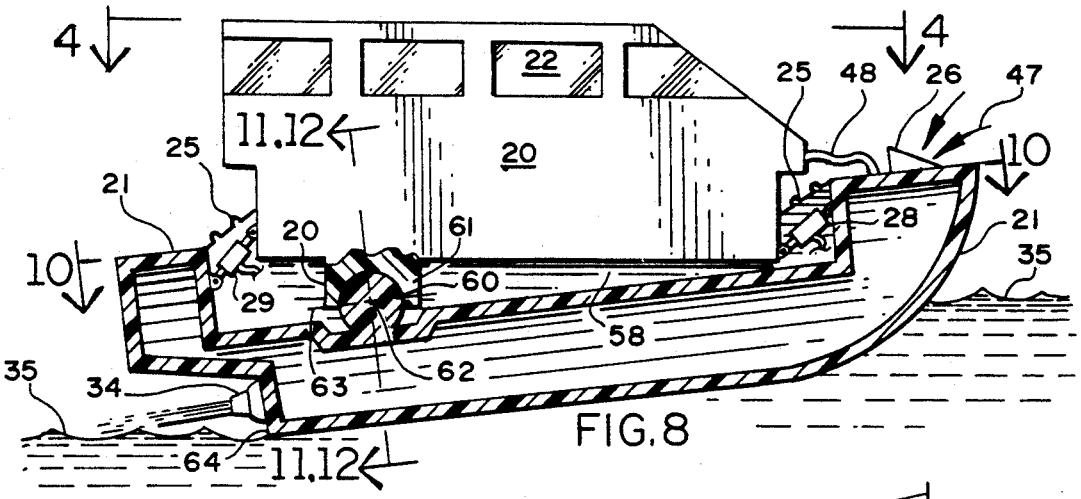
FIG. 8 shows a partial cross sectional view which shows a simplified version of the instant invention where a main support ball and socket or hinge arrangement connects the parent and secondary structure and is positioned proximal the lowest movement and most stable part of a boat hull. These simplest versions of the instant invention are probably the most applicable to early commercial development as they are simple, low in cost, and reliable.

FIG. 8 presents a partial cross sectional view of a simple version of the instant invention, when operating in rough seas, that utilizes ball and socket or hinge male 60 and female 61 portions that are preferably located at a minimum movement position on the parent structure 21. This is longitudinally located at a parent structure transverse centerline 62 that is intersected by a parent structure longitudinal centerline 63 in this instance. Other items shown in FIG. 8 are a hull transom 64, secondary structure 20 supporting gas cushion 58, actuators 28,29, blower inlet 26, air flow arrows 47, connecting seal member 25, secondary structure passenger cabin windows 22, connecting cable 48, waterjet propulsor 34, and rough sea wave waterlines 35.

Figure 9:
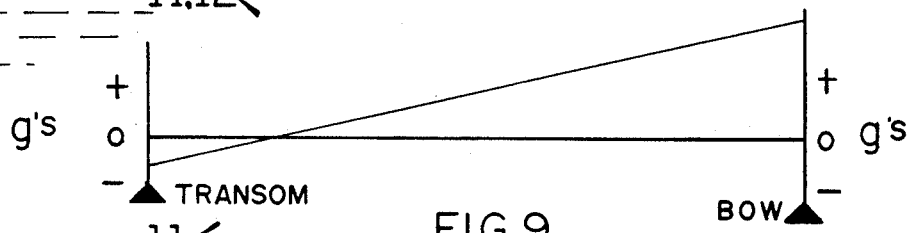
FIG. 9 presents a graph that shows the approximate shape of a g-force vs. boat waterline length curve that can be expected for a typical boat, such as shown in FIG. 8, when operating in rough seas. It can be seen from the graph that locating the contact point between the parent and secondary structure to be at or near a position about 25 percent forward of the transom will result in near zero-g operation.

FIG. 9 introduces a plot of g-forces to be expected vs. hull length over a wetted waterline length of the hull shown in FIG. 8. It can be seen that it is very desirable to place the connecting hinge or ball and socket of FIG. 8 at or near a point about 25 percent of waterline length forward of the stern or, said another way, about halfway between midships and the hull transom as that is the point of minimum movement and g-force level for this hull type parent structure under most rough sea operating conditions.

Figure 10:
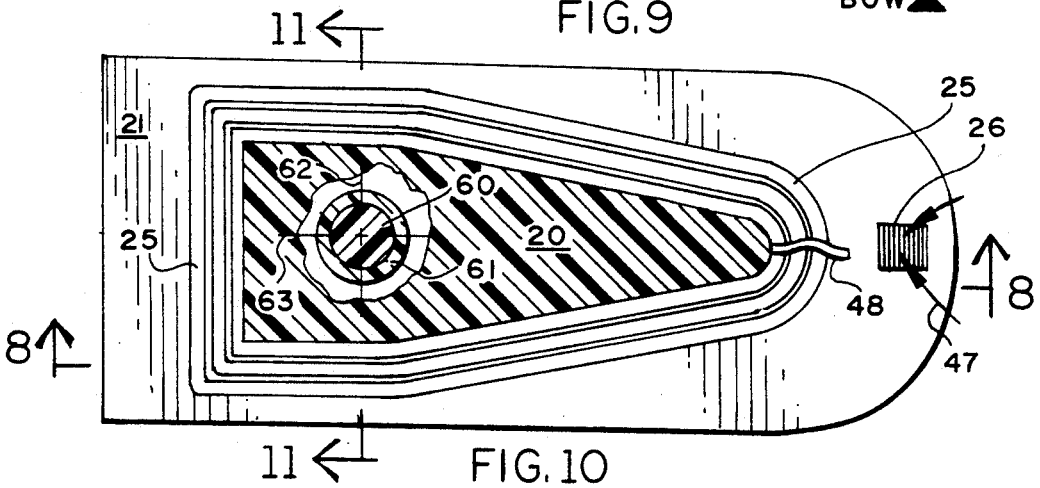
FIG. 10 shows a partial cutaway top plan view of a boat as taken through line 10—10 of FIG. 8. This shows a ball and socket as part of a partial cutaway view. Importantly also, shown is a secondary structure base that is smaller transversely forward than aft. The latter is an option that is done to equalize gas cushion force moments about the transverse centerline plane of the ball and socket.

FIG. 10 is a top plan view of the hull of FIG. 8, as taken through line 10—10 of FIG. 8, that shows a partial cutaway view of the secondary structure 20 and a further partial cutaway that shows a secondary structure supporting male ball 60, and female socket 61, and their transverse centerline 62 and longitudinal centerline 63. Also shown are a connecting seal 25, parent structure 21, blower inlet 26, air flow arrows 48, and connecting cable 48. It is important to note that the gas cushion contacting portion of the secondary structure 20 is narrowing, and in this instance, bullet shaped forward of the ball and socket 60,61 and larger in width aft. This was done to allow better distribution of gas cushion generated force moments around the transverse centerline 62. It is also to be noted that the secondary structure 20 can be increased in width above the narrower lower sections if desired to make for more rectangular secondary structure deck spaces.

Figure 11:
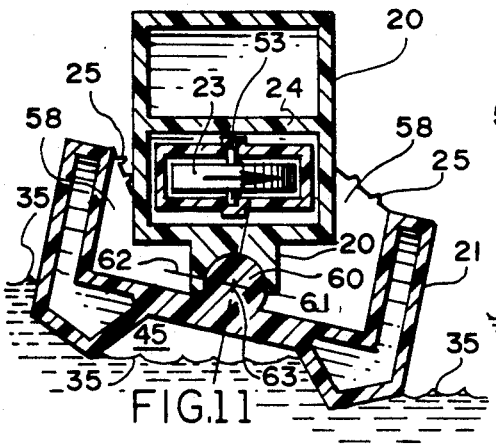
FIG. 11 presents a cutaway view, as taken through line 11—11 of FIG's 8 and 10, that shows operation of a ball and socket connector when installed in boat that is operating in rough beam seas.

FIG. 11 presents a cross sectional view, as taken through line 11—11 of FIGS. 8 and 10, that shows the hull or parent structure 21 operating in rough seas as shown by waterlines 35. In such instance, the secondary structure 20 remains substantially horizontal as is influenced by the gyrostabilizer 23 with alignment movement allowed by male ball 60 and female socket 61. Ball and socket ball and socket centerlines 62 and 63 relative to the parent structure 21 are also shown. Other items shown in FIG. 11 are the gyroscope axis 53, gyroscope cage 24, secondary structure gas cushion 58, gas cushion seal 25, and parent structure supporting gas cushion 45.

Figure 12:
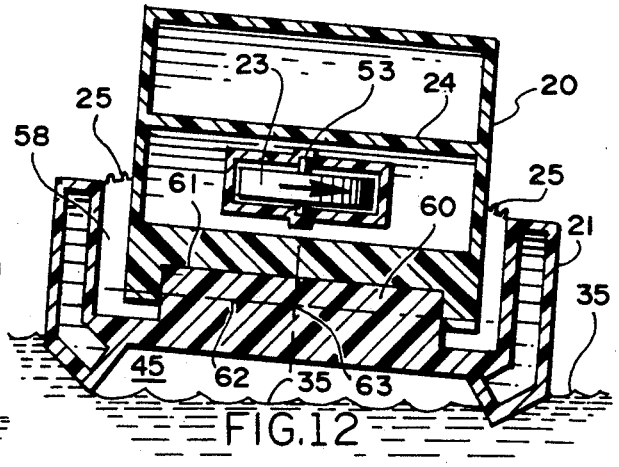
FIG. 12 shows a cutaway view, as taken through line 12—12 of FIG. 8, that illustrates a hinge like connector arrangement. Note that in this figure the hull is very wide and stable, as is the case of the Air Ride boat designs, and therefore the parent structure, in this case a boat, is very stable in roll so the low cost hinge design shown is simple and effective in such instances.

FIG. 12 presents a cross sectional view, as taken through line 12—12 of FIG. 8, that shows a wider and more stable transversely parent structure 21, such as my Air Ride boat inventions, than that shown in FIG. 11. Since the transverse or roll movements of such a wide design are minimal, it is possible to utilize a very simple hinge like connector design such as is shown by male portion 60 and female portion 61. The transverse centerline 62 and longitudinal centerline 63 of the hinge like connector are also shown. The limitation of this approach is that the only movement that can be compensated for is in pitch—the advantages are a very simple, low cost, reliable concept. Also shown are a parent structure 21 supporting gas cushion 45, sea waterline 35, secondary structure supporting gas cushion 58, connecting seal element 25, gyroscope rotor 23, gyroscope axis 53, gyroscope cage 24, and secondary structure 20.

It is easily recognized that other hinge or single element connector designs can be utilized instead of the ball and socket or hinge concepts shown in FIGS. 11 and 12. It is also possible to allow the hinge-like or ball and socket connector points on the parent and/or secondary structures to be movably and/or resiliently mounted, have variable position mounts that can tilt or otherwise be oriented as desired, or be equipped with other mounting variations if desired. Although not shown, such variations are easily within the scope of the instant invention.

While the invention has been described in connection with a preferred and several alternative embodiments, it will be understood that there is no intention to thereby limit the invention. On the contrary, there is intended to be covered all alternatives, modifications and equivalents as may be included within the spirit and scope of the invention as defined by the appended claims, which are the sole definition of the invention.

What is claimed is:

1. Apparatus to provide support for and stabilization of a secondary structure relative to a parent structure comprising:

a secondary structure supporting gas cushion disposed, at least in part, between the secondary and parent structures, said secondary structure supporting gas cushion in communication with the secondary and the parent structures, and an upper surface area of said secondary structure supporting gas cushion equals a majority of a secondary structure lower surface area; and a gyrostabilizer in communication with the secondary structure wherein said gyrostabilizer stabilizes, at least partially, said secondary structure when said secondary structure is, at least in part, supported by said secondary structure supporting gas cushion and wherein orientation of said gyrostabilizer is directed by outputs from a controller based, at least in part, on inputs of secondary structure orientation to the controller.

2. The secondary structure support and stabilization apparatus of claim 1 which further includes a seal terminating proximal to and extending proximal a majority of a length of an outer periphery of said secondary structure lower surface that is in communication with said secondary structure supporting gas cushion, said seal being in communication with said parent structure.

3. The secondary structure support and stabilization apparatus of claim 1 wherein orientation of the gyrostabilizer is directed by outputs from a controller based, at least in part, on inputs of parent structure orientation to the controller.

4. The secondary structure support and stabilization apparatus of claim 1 wherein the secondary structure supporting gas cushion is supplied with gas from a pressurized gas supply device.

5. The secondary structure support and stabilization apparatus of claim 4 wherein the pressurized gas supply device is, at least in part, a powered blower.

6. The secondary structure support and stabilization apparatus of claim 1 wherein a parent structure supporting gas cushion is positioned, at least in part, in an underside of the parent structure and said parent structure supporting gas cushion is restrained, at least in part, by the parent structure and a supporting medium of said parent structure.

7. The secondary structure support and stabilization apparatus of claim 6 wherein the parent structure supporting gas cushion is supplied with gas from a pressurized gas supply device.

8. The secondary structure support and stabilization apparatus of claim 6 wherein pressurized gas can pass between the secondary structure supporting gas cushion and the parent structure supporting gas cushion.

9. The secondary structure support and stabilization apparatus of claim 8 wherein gas passing between the secondary structure supporting gas cushion and the parent structure supporting gas cushion flows through a gas pressure regulating device.

10. The secondary structure support and stabilization apparatus of claim 1 wherein the secondary structure supporting gas cushion penetrates through the parent structure so that at least part of the secondary structure supporting gas cushion is restrained by a supporting medium of said parent structure.

11. The secondary structure support and stabilization apparatus of claim 1 wherein the secondary structure supporting gas cushion is at least partially located in a recess in the parent structure.

12. The secondary structure support and stabilization apparatus of claim 1 wherein pressurized gas is supplied to a secondary structure supporting gas cushion through a gas pressure regulating device.

13. The secondary structure support and stabilization apparatus of claim 1 wherein pressurized gas can be vented through a pressure regulating device from a secondary structure supporting gas cushion.

14. The secondary structure support and stabilization apparatus of claim 1 wherein at least one connector supports, at least in part, the secondary structure relative to the parent structure.

15. The secondary structure support and stabilization apparatus of claim 1 wherein at least one connector stabilizes, at least in part, the secondary structure relative to the parent structure.

16. The secondary structure support and stabilization apparatus of claim 1 wherein a secondary structure supporting gas cushion stabilizes, at least in part, the secondary structure.

17. The secondary structure support and stabilization apparatus of claim 1 wherein said secondary structure supporting gas cushion is comprised of multiple smaller gas cushions.

18. In an improved apparatus for supporting and stabilizing a secondary structure relative to a parent structure that includes a connector in communication with the secondary structure and the parent structure, wherein said connector provides at least partial stabilization means for said secondary structure, the improvement comprising:

a secondary structure supporting gas cushion disposed, at least in part, between the secondary and parent structures and said secondary structure supporting gas cushion is restrained, at least in part, by portions of the secondary and the parent structures wherein a majority of a lower surface of said secondary structure comprises an upper boundary of said secondary structure supporting gas cushion, a seal terminating proximal to an extending proximal a majority of a length of an outer periphery of said secondary structure lower surface that is in communication with said secondary structure supporting gas cushion, said seal being in communication with said parent structure and wherein said secondary structure supporting gas cushion supports, at least in part, a weight of said secondary structure.

19. The secondary structure support and stabilization apparatus of claim 18 wherein the secondary structure supporting gas cushion is supplied with gas from a pressurized gas supply device.

20. The secondary structure support and stabilization apparatus of claim 18 wherein a parent structure supporting gas cushion is positioned, at least in part, in an underside of the parent structure and said parent structure supporting gas cushion is restrained, at least in part, by the parent structure and a supporting medium of said parent structure.

21. The secondary structure support and stabilization apparatus of claim 20 wherein a parent structure supporting gas cushion is supplied with gas from a pressurized gas supply device.

22. The secondary structure support and stabilization apparatus of claim 21 wherein the pressurized gas supply device is, at least in part, a powered blower.

23. The secondary structure support and stabilization apparatus of claim 20 wherein pressurized gas can pass between the secondary structure supporting gas cushion and the parent structure gas cushion.

24. The secondary structure support and stabilization apparatus of claim 23 wherein gas passing between the secondary structure supporting gas cushion and the parent structure supporting gas cushion flows through a gas pressure regulating device.

25. The secondary structure support and stabilization apparatus of claim 18 wherein a secondary structure supporting gas cushion penetrates through the parent structure so that at least part of the secondary structure supporting gas cushion is restrained by a supporting medium of said parent structure.

26. The secondary structure support and stabilization apparatus of claim 18 wherein the secondary structure supporting gas cushion is at least partially located in a recess in the parent structure.

27. The secondary structure support and stabilization apparatus of claim 18 wherein pressurized gas is supplied to the secondary structure supporting gas cushion through a gas pressure regulating device.

28. The secondary structure support and stabilization apparatus of claim 18 wherein pressurized gas in the secondary structure supporting gas cushion is confined from escape.

29. The secondary structure support and stabilization apparatus of claim 18 wherein pressurized gas can be vented through a pressure regulating device from the secondary structure supporting gas cushion.

30. The secondary structure support and stabilization apparatus of claim 18 wherein at least one connector supports, at least in part, the secondary structure relative to the parent structure.

31. The secondary structure support and stabilization apparatus of claim 18 wherein a gyrostabilizer, that is in communication with the secondary structure, stabilizes, at least partially, said secondary structure.

32. The secondary structure support and stabilization apparatus of claim 31 wherein orientation of the gyrostabilizer is directed by outputs from a controller based, at least in part, on inputs of secondary structure orientation to the controller.

33. The secondary structure support and stabilization apparatus of claim 32 wherein orientation of the gyrostabilizer is directed by outputs from a controller based, at least in part, on inputs of parent structure orientation to the controller.

34. The secondary structure support and stabilization apparatus of claim 18 wherein the secondary structure supporting gas cushion stabilizes, at least in part, the secondary structure.

35. The secondary structure support and stabilization apparatus of claim 18 wherein said secondary structure supporting gas cushion is comprised of multiple smaller gas cushions.

36. In an improved apparatus for supporting and stabilizing a secondary structure relative to a parent structure that includes a connector in communication with the secondary structure and the parent structure, wherein said connector provides at least partial support for the secondary structure, the improvement comprising:

a gyrostabilizer in communication with the secondary structure wherein said gyrostabilizer orients and stabilizes, at least in part, said secondary structure relative to the parent structure when said secondary structure is supported, at least in part, by a secondary structure supporting gas cushion and wherein orientation of said gyrostabilizer is directed by outputs from a controller based, at least in part, on inputs of secondary structure orientation to the controller.

37. The secondary structure support and stabilization apparatus of claim 36 wherein orientation of a secondary structure stabilizing gyrostabilizer is directed by outputs from a controller based, at least in part, on inputs of parent structure orientation to the controller.

38. The secondary structure support and stabilization apparatus of claim 36 wherein the secondary structure supporting gas cushion is disposed, at least in part, between the secondary and parent structures, said secondary structure supporting gas cushion in communication with the secondary and the parent structures, and an upper surface area of said secondary structure supporting gas cushion equals at least a majority of a secondary structure lower surface area.

39. The secondary structure support and stabilization apparatus of claim 38 wherein pressurized gas in the secondary structure supporting gas cushion is restrained, at least in part, by a seal wherein said seal is in communication with the secondary and the parent structures.

40. The secondary structure support and stabilization apparatus of claim 38 wherein the secondary structure supporting gas cushion is supplied with gas from a pressurized gas supply device.

41. The secondary structure support and stabilization apparatus of claim 40 wherein the pressurized gas supply device is, at least in part, a powered blower.

42. The secondary structure support and stabilization apparatus of claim 38 wherein a parent structure supporting gas cushion is positioned, at least in part, in an underside of the parent structure and said parent structure gas cushion is restrained, at least in part, by the parent structure and a supporting medium of said parent structure.

43. The secondary structure support and stabilization apparatus of claim 42 wherein the parent structure supporting gas cushion is supplied with gas from a pressurized gas supply device.

44. The secondary structure support and stabilization apparatus of claim 38 wherein pressurized gas can pass between the secondary structure supporting gas cushion and the parent structure supporting gas cushion.

45. The secondary structure support and stabilization apparatus of claim 36 wherein the secondary structure supporting gas cushion penetrates through the parent structure so that part of a secondary structure supporting gas cushion is restrained by a supporting medium of said parent structure.

46. The secondary structure support and stabilization apparatus of claim 36 wherein pressurized gas can be vented through a pressure regulating device from a secondary structure supporting gas cushion.

47. The secondary structure support and stabilization apparatus of claim 36 wherein pressurized gas in the secondary structure supporting gas cushion is confined from escape.

48. The secondary structure support and stabilization apparatus of claim 36 wherein at least one connector stabilizes, at least in part, the secondary structure relative to the parent structure.

49. The secondary structure support and stabilization apparatus of claim 38 wherein a secondary structure supporting gas cushion stabilizes, at least in part, the secondary structure.

50. The secondary structure support and stabilization apparatus of claim 36 wherein a majority of a lower surface of said secondary structure comprises an upper boundary of said secondary structure supporting gas cushion, a seal terminating proximal to and extending proximal a majority of a length of an outer periphery of said secondary structure lower surface that is in communication with said secondary structure supporting gas cushion, said seal being in communication with said parent structure.

51. The secondary structure support and stabilization apparatus of claim 36 wherein said secondary structure supporting gas cushion is comprised of multiple smaller gas cushions.

52. In an improved apparatus for supporting and stabilizing a secondary structure relative to a parent structure that includes a connector in communication with the secondary structure and the parent structure, wherein said connector provides at least partial stabilization means for said secondary structure, the improvement comprising:

a secondary structure supporting gas cushion disposed, at least in part, between the secondary and parent structures and said secondary structure supporting gas cushion is restrained, at least in part, by a portion of the parent structure and wherein a parent structure supporting gas cushion is positioned, at least in part, in an underside of the parent structure and wherein said parent structure supporting gas cushion is restrained, at least in part, by the parent structure and a supporting medium of said parent structure and wherein one of said supporting gas cushions is supplied with gas from a pressurized gas supply device and wherein pressurized gas can pass between the secondary structure supporting gas cushion and the parent structure supporting gas cushion.

53. The secondary structure support and stabilization apparatus of claim 52 wherein pressurized gas in the secondary structure supporting gas cushion is restrained, at least in part, by a seal wherein said seal is in communication with the secondary and the parent structures.

54. The secondary structure support and stabilization apparatus of claim 52 wherein the secondary structure supporting gas cushion is supplied with gas from a pressurized gas supply device.

55. The secondary structure support and stabilization apparatus of claim 54 wherein the pressurized gas supply device is, at least in part, a powered blower.

56. The secondary structure support and stabilization apparatus of claim 52 wherein the secondary structure supporting gas cushion penetrates through the parent structure so that at least part of the secondary structure supporting gas cushion is restrained by the parent structure's supporting medium.

57. The secondary structure support and stabilization apparatus of claim 52 wherein the secondary structure supporting gas cushion is at least partially located in a recess in the parent structure.

58. The secondary structure support and stabilization apparatus of claim 52 wherein pressurized gas is supplied to the secondary structure supporting gas cushion through a gas pressure regulating device.

59. The secondary structure support and stabilization apparatus of claim 52 wherein pressurized gas in the secondary structure supporting gas cushion is confined from escape.

60. The secondary structure support and stabilization apparatus of claim 52 wherein pressurized gas can be vented through a pressure regulating device from the secondary structure supporting gas cushion.

61. The secondary structure support and stabilization apparatus of claim 52 wherein the secondary structure supporting gas cushion stabilizes, at least in part, the secondary structure.

62. The secondary structure support and stabilization apparatus of claim 52 wherein a gyrostabilizer is in communication with the secondary structure and said gyrostabilizer stabilizes, at least partially, said secondary structure.

63. The secondary structure support and stabilization apparatus of claim 62 wherein orientation of the gyrostabilizer is directed by outputs from a controller based, at least in part, on inputs of secondary structure orientation to the controller.

64. The secondary structure support and stabilization apparatus of claim 62 where orientation of the gyrostabilizer is directed by outputs from a controller based, at least in part, on inputs of parent structure orientation to the controller.

65. The secondary structure support and stabilization apparatus of claim 52 wherein a majority of a lower surface of said secondary structure comprises an upper boundary of said secondary structure supporting gas cushion, a seal terminating proximal to and extending proximal a majority of a length of an outer periphery of said secondary structure lower surface that is in communication with said secondary structure supporting gas cushion, said seal being in communication with said parent structure.

66. The secondary structure support and stabilization apparatus of claim 52 wherein said secondary structure supporting gas cushion is comprised of multiple smaller gas cushions.

67. Apparatus to provide support for and stabilization of a secondary structure relative to a parent structure comprising:

a pivoting connector connecting said secondary structure and the parent structure, said pivoting connector allowing fore and aft tilting of said secondary structure about a substantially transverse centerline of said pivoting connector, a secondary structure supporting gas cushion disposed, at least in part between the secondary and parent structures and said secondary structure supporting gas cushion is in communication with the secondary and the parent structures; and said secondary structure supporting gas cushion equals at least a majority of a secondary structure lower surface area.

68. The secondary structure support and stabilization apparatus of claim 67 wherein said pivoting connector is positioned proximal a minimum movement portion of the parent structure.

69. The secondary structure support and stabilization apparatus of claim 67 which further includes a second connector connecting said secondary structure and the parent structure, said second connector capable of, at least partially, orienting said secondary structure relative to the parent structure.

70. The secondary structure supporting gas cushion of claim 67 wherein said secondary structure supporting gas cushion is comprised of multiple smaller gas cushions.

71. The secondary structure support and stabilization apparatus of claim 67 which further includes a seal terminating proximal to and extending proximal a majority of a length of an outer periphery of said secondary structure lower surface that is in communication with said secondary structure supporting gas cushion, said seal being in communication with said parent structure.

72. The secondary structure support and stabilization apparatus of claim 67 which further comprises a gyrostabilizer in communication with the secondary structure wherein said gyrostabilizer stabilizes, at least partially, said secondary structure.

73. The pivoting connector of claim 67 wherein said pivoting connector is, at least in part, a ball and socket.

74. The pivoting connector of claim 67 wherein said pivoting connector is, at least in part, a hinge-like apparatus.

75. The secondary structure support and stabilization apparatus of claim 67 wherein a lower surface of said secondary structure extends a greater distance from one side of said pivoting connector that from the other side of said pivoting connector.

76. The lower surface of said secondary structure of claim 75 where said lower surface has, at least in part, narrower sections on one side of the pivoting connector than on an opposite side of the pivoting connector.

77. The secondary structure support and stabilization apparatus of claim 67 wherein the secondary structure supporting gas cushion is supplied with gas from a pressurized gas supply device.

78. The secondary structure support and stabilization apparatus of claim 67 wherein a parent structure supporting gas cushion is positioned, at least in part, in an underside of the parent structure and said parent structure supporting gas cushion is restrained, at least in part, by the parent structure and a supporting medium of said parent structure.

79. The secondary structure support and stabilization apparatus of claim 78 wherein the parent structure supporting gas cushion is supplied with gas from a pressurized gas supply device.

80. The secondary structure support and stabilization apparatus of claim 78 wherein pressurized gas can pass between the secondary structure supporting gas cushion and the parent structure supporting gas cushion.

81. The secondary structure support and stabilization apparatus of claim 80 wherein gas passing between the secondary structure supporting gas cushion and the parent structure supporting gas cushion flows through a gas pressure regulating device.

82. The secondary structure support and stabilization apparatus of claim 78 wherein the secondary structure supporting gas cushion penetrates through the parent structure so that at least part of the secondary structure supporting gas cushion is restrained by a supporting medium of said parent structure.

83. The secondary structure support and stabilization apparatus of claim 67 wherein the secondary structure supporting gas cushion is at least partially located in a recess in the parent structure.

84. The secondary structure support and stabilization apparatus of claim 67 wherein pressurized gas can be vented through a pressure regulating device from a secondary structure supporting gas cushion.

85. The secondary structure support and stabilization apparatus of claim 68 wherein the parent structure is a boat hull and the minimum movement portion of said parent structure is positioned aft of midships of said boat hull.

86. Apparatus to provide support for and stabilization of a secondary structure relative to a parent structure comprising:

a pivoting connector connecting said secondary structure and the parent structure, said pivoting connector allowing fore and aft tilting of said secondary structure about a substantially transverse centerline of said pivoting connector, said pivoting connector positioned proximal a minimum movement portion of said parent structure, a second connector connecting said secondary structure and the parent structure, said second connector capable of, at least partially, orienting said secondary structure relative to the parent structure, and a secondary structure supporting gas cushion disposed, at least in part, between the secondary and parent structures and said secondary structure supporting gas cushion is in communication with the secondary and the parent structures.

87. The secondary structure support and stabilization apparatus of claim 86 wherein an upper surface area of said secondary structure supporting gas cushion equals at least a majority of a secondary structure lower surface area.

88. The secondary structure support and stabilization apparatus of claim 87 wherein said secondary structure supporting gas cushion is comprised of multiple smaller gas cushions.

89. The secondary structure support and stabilization apparatus of claim 86 which further includes a seal terminating proximal to and extending proximal a majority of a length of an outer periphery of said secondary structure lower surface that is in communication with said secondary structure supporting gas cushion, said seal being in communication with said parent structure.

90. Apparatus to provide support for and stabilization of a secondary structure relative to a parent structure comprising:

a pivoting connector connecting said secondary structure and the parent structure, said pivoting connector allowing fore and aft tilting of said secondary structure about a substantially transverse centerline of said pivoting connector, a gyrostabilizer in communication with the secondary structure wherein said gyrostabilizer stabilizes, at least partially, said secondary structure and wherein orientation of said gyrostabilizer is directed by outputs from a controller based, at least in part, on inputs of secondary structure orientation to the controller, and a secondary structure supporting gas cushion disposed, at least in part, between the secondary and parent structures and said secondary structure supporting gas cushion is in communication with the secondary and the parent structures.

91. The secondary structure support and stabilization apparatus of claim 90 wherein said pivoting connector is positioned proximal a minimum movement portion of the parent structure.

92. The secondary structure supporting gas cushion of claim 90 wherein an upper surface area of said secondary structure supporting gas cushion equals a majority of a secondary structure lower surface area.

93. The secondary structure support and stabilization apparatus of claim 92 wherein said secondary structure supporting gas cushion is comprised of multiple smaller gas cushions.

94. The secondary structure support and stabilization apparatus of claim 90 which further includes a seal terminating proximal to and extending proximal a majority of a length of an outer periphery of said secondary structure lower surface that is in communication with said secondary structure supporting gas cushion, said seal being in communication with said parent structure.

95. The secondary structure support and stabilization apparatus of claim 90 wherein a lower surface of said secondary structure extends a greater distance from one side of said pivoting connector than from the other side of said pivoting connector.

96. The secondary structure support and stabilization apparatus of claim 90 wherein the parent structure is a boat hull and the minimum movement portion of said parent structure is positioned aft of midships of said boat hull.

* * * * *